US006474950B1

(12) United States Patent
Waldo

(10) Patent No.: US 6,474,950 B1
(45) Date of Patent: Nov. 5, 2002

(54) OIL FREE DRY SCREW COMPRESSOR INCLUDING VARIABLE SPEED DRIVE

(75) Inventor: Keith D. Waldo, Mooresville, NC (US)

(73) Assignee: Ingersoll-Rand Company, Woodcliff Lake, NJ (US)

( * ) Notice: Subject to any disclaimer, the term of this patent is extended or adjusted under 35 U.S.C. 154(b) by 3 days.

(21) Appl. No.: 09/615,753

(22) Filed: Jul. 13, 2000

(51) Int. Cl.[7] ..... F04B 49/06
(52) U.S. Cl. ..... 417/12; 417/44.2
(58) Field of Search ..... 417/28, 36, 44.2, 417/45, 310, 12; 418/201.1

(56) References Cited

U.S. PATENT DOCUMENTS

| | | | | | |
|---|---|---|---|---|---|
| 3,216,648 | A | | 11/1965 | Ford | |
| 3,226,011 | A | | 12/1965 | Gustafson | |
| 3,582,233 | A | | 6/1971 | Bloom | |
| 3,819,298 | A | | 6/1974 | Hadnagy et al. | |
| 3,985,467 | A | | 10/1976 | Lefferson | |
| 4,009,971 | A | | 3/1977 | Krohn et al. | |
| 4,770,615 | A | * | 9/1988 | Fujiwara et al. | 418/201.1 |
| 4,828,462 | A | | 5/1989 | McBurnett | |
| 4,832,579 | A | | 5/1989 | Norton | |
| RE33,116 | E | | 11/1989 | Suzuki | |
| 5,106,270 | A | | 4/1992 | Goettel et al. | |
| 5,110,264 | A | | 5/1992 | Murry | |
| 5,112,199 | A | | 5/1992 | Otaki et al. | |
| 5,246,349 | A | * | 9/1993 | Hartog | 417/371 |
| 5,284,202 | A | | 2/1994 | Dickey et al. | |
| 5,515,676 | A | * | 5/1996 | Earle | 417/12 |
| 5,522,707 | A | | 6/1996 | Potter | |
| 5,664,937 | A | | 9/1997 | Takahashi et al. | |
| 5,707,211 | A | * | 1/1998 | Kochan | 417/44.2 |
| 5,820,352 | A | | 10/1998 | Gunn et al. | |
| 5,865,602 | A | | 2/1999 | Nozari | |
| 5,888,051 | A | | 3/1999 | McLoughlin et al. | |
| 6,045,331 | A | * | 4/2000 | Gehm et al. | 417/44.2 |
| 6,068,447 | A | * | 5/2000 | Foege | 417/12 |
| 6,074,170 | A | * | 6/2000 | Bert et al. | 417/44.2 |
| 6,146,100 | A | * | 11/2000 | Broucke | 417/44.2 |
| 6,264,431 | B1 | * | 7/2001 | Triezenberg | 417/36 |

* cited by examiner

*Primary Examiner*—Michael Koczo
(74) *Attorney, Agent, or Firm*—Michael Best & Friedrich LLP

(57) ABSTRACT

An oil-free dry screw compressor system is provided and includes a variable speed drive and motor along with control logic to increase or decrease the speed of the drive and motor based on sensed pressures. By using an electric motor and a rectifier/inverter drive, a variable speed compressor system is provided having a drive system that can be stopped and started an unlimited number of times over a given time period. Methods of controlling pressure in a compressor system including an oil-free dry screw compressor are also provided.

10 Claims, 2 Drawing Sheets

OIL FREE DRY SCREW COMPRESSOR INCLUDING VARIABLE SPEED DRIVE

BACKGROUND OF THE INVENTION

The present invention relates to oil-free dry screw compressors and methods of controlling oil-free dry screw compressor systems.

Compressor systems employing induction drives are known. Limitations on the frequency of starting and stopping induction motors have posed limitations on the ability of compressor systems using such motors to conserve energy. As a result, many induction drive compressor systems employ continuously running drives and motors and control pressure in the system by frequently releasing built up pressure through a blowdown valve. Such a design does not provide a system that can control pressure over an entire 0% to 100% demand range.

Although variable speed pumps and drives are known, for example, from U.S. Pat. Nos. 5,522,707 and 3,216,648, which are both incorporated herein in their entireties by reference, a need exists for a variable speed compressor of an oil-free type that includes a drive and motor system capable of being shut off or stopped and restarted an unlimited number of times during any given time period. A need also exists for a method of controlling pressure in a compressor system whereby a constant pressure can be maintained over an entire 0% to 100% demand range.

SUMMARY OF THE INVENTION

The present invention provides an oil-free dry screw compressor having a variable speed drive. More particularly, the present invention provides an oil-free dry screw compressor system preferably having two or more compression stages. Preferably, the system includes a rectifier/inverter drive that can rectify an alternating current to a direct current and invert a direct current to an alternating current, and an electric motor with controls to start and stop the motor an unlimited number of times over a given time period. Preferably, the compressor system includes two or more airends or stages that are free of conventional inlet valves. The two or more airends or stages are preferably driven by a single variable speed drive and motor through a gear system that provides simultaneous compression in both airends or stages.

The present invention also relates to a method for controlling the pressure of a compressed fluid produced by an oil-free dry screw compressor. The method includes compressing a fluid with an oil-free dry screw compressor driven by a variable speed drive, flowing compressed fluid generated by the oil-free dry screw compressor through a compressed fluid conduit, sensing the pressure of compressed fluid in the compressed fluid conduit, and adjusting the speed of the variable speed drive in response to the pressure sensed in the compressed fluid conduit.

It is to be understood that both the foregoing general description and the following detailed description are exemplary and explanatory only and are only intended to provide a further explanation of the present invention, as claimed. The accompanying drawings, which are incorporated in and constitute a part of this application, illustrate several exemplary embodiments of the present invention and together with description, serve to explain the principles of the present invention.

BRIEF DESCRIPTION OF THE DRAWINGS

The invention may be more fully understood with reference to the accompanying figures. The figures are intended to illustrate exemplary embodiments of the present invention without limiting the scope of the invention.

DETAILED DESCRIPTION

Figure 1:
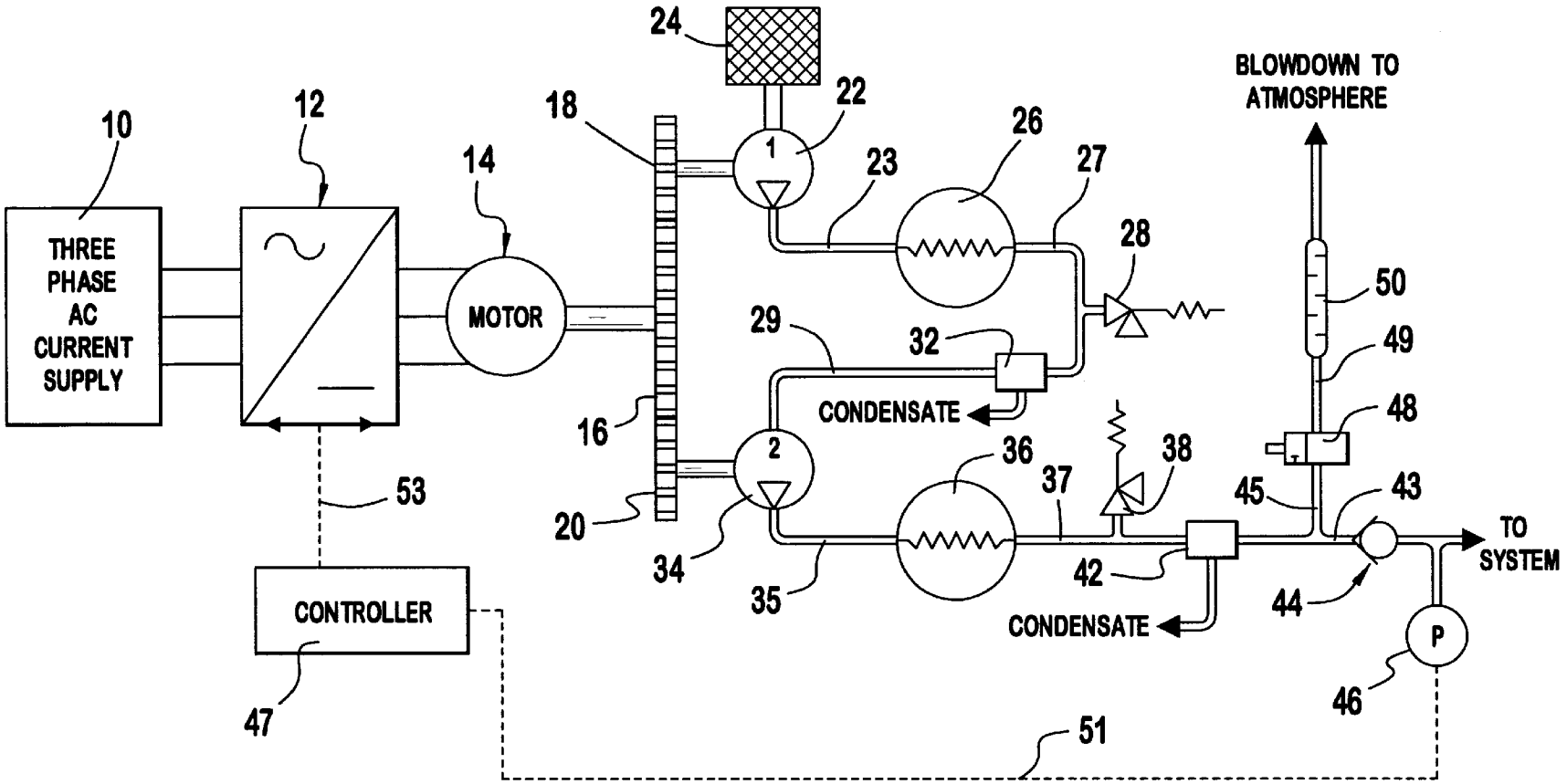
FIG. 1 is a schematic flow diagram showing an oil-free dry screw compressor system according to an embodiment of the present invention.

The present invention provides an oil-free dry screw compressor having a variable speed drive. More particularly, the present invention provides an oil-free dry screw compressor system preferably having two or more compression stages and preferably including a rectifier/inverter drive that can rectify an AC signal to a DC signal and invert a DC signal to an AC signal, and an electric motor with controls to start and stop the motor an unlimited number of times over a given time period. Preferably, the compressor system includes two or more compressors, airends, or stages that are free of conventional inlet valves. The two or more compressors, airends, or stages are preferably driven by a single variable speed drive and motor through a gear system that provides simultaneous compression in both compressors, airends, and/or stages. Herein, what is meant by an oil-free dry screw compressor is a compressor of the type which is capable of operation without requiring oil to be fed to a working chamber of the compressor. Preferably, the compressor has a pressure ratio of approximately three or four, although higher ratios may be employed. The oil-free or oilless dry screw compressors of the present invention can supply a clean pressurized fluid such as air or other gas having substantially no oil incorporated therein, and preferably having no oil whatsoever incorporated therein. An oilless screw compressor system is described in U.S. Pat. No. Re. 33,116, which is incorporated herein in its entirety by reference.

The present invention also relates to a method for controlling the pressure of a compressed fluid produced by an oil-free dry screw compressor. According to the present invention, the method includes compressing a fluid with an oil-free dry screw compressor driven by a variable speed drive, flowing compressed fluid generated by the oil-free dry screw compressor through a compressed fluid conduit, sensing the pressure of compressed fluid in the compressed fluid conduit, and adjusting the speed of the variable speed drive in response to the pressure sensed in the compressed fluid conduit.

According to the present invention, an oil-free dry screw compressor is provided having a pressure control design that eliminates the inlet valve conventionally used in oil-free dry screw compressors. According to the present invention, pressure in the oil-free dry screw compressor design is controlled by controlling the compressor speed with a variable speed motor and drive, and blowing down the last stage pressure with a blowdown valve, for example, a solenoid-actuated blowdown valve. When a target air demand in the system is achieved while the compressor is driven at its minimum drive speed, a motor start/stop control is employed to stop the compressor until a demand for increased pressure arises.

According to the present invention, the variable speed motor and drive maintain a constant pressure downstream in the system by speeding up or slowing down one or more airends of the system in response to a signal indicative of a pressure sensed in a compressed fluid conduit downstream of the one or more airends. A constant pressure can be maintained by speeding up or slowing down the variable speed motor and drive provided a target pressure band can be maintained in the acceptable speed range of the dry screw compressor. When the pressure sensed in the system begins to rise and approach a maximum value of a desired pressure band, a constant pressure controller receives a signal indicative of the sensed pressure and controls the motor and drive to slow the compressor down. If pressure in the system continues to rise after the compressor has been slowed down to its minimum speed, the constant pressure controller will cease to control pressure and pressure will then be maintained by starting and stopping the motor and drive. The starting and stopping will continue so as to keep the system pressure within the acceptable pressure band. If the system pressure reaches a maximum threshold value, the motor and drive will stop and a blowdown valve will open to relieve last stage discharge pressure. When the pressure falls below a minimum threshold level, the blowdown valve closes and the motor and drive are started. Preferably, once started, the motor and drive are run at the minimum compressor speed unless a relatively high pressure is demanded. According to the present invention, there is no limit to the number of starts and stops on the motor due to the ramp-up nature of the drive.

The control afforded by the present invention reduces the overall power required to maintain system gas pressure by matching the compressor input power to the required flow and by shutting off the motor when there is no demand for gas. The system design minimizes the need to blowdown excess pressure and thus conserves energy otherwise lost to blowdown.

A preferred variable speed motor and drive system for use in accordance with the present invention includes a rectifier/inverter drive system, for instance, a three-phase alternating current power supply in combination with a rectifier/inverter drive and an electric motor.

Referring now to FIG. 1, an embodiment of the present invention is exemplified. As shown in FIG. 1, a three-phase AC power supply 10 provides a three phase alternating current to a rectifier/inverter drive 12 which in turn provides a variable speed drive signal to an electric motor 14. The drive 12 can preferably rectify alternating current from the AC power supply to DC current, and invert DC current to AC current as a means of providing a variable power supply to the motor. With such a drive, a standard induction motor can be used. Alternatively, other types of drives can be used provided they are coupled with an appropriate variable speed motor that preferably can start and stop an unlimited number of times over a given period.

The electric motor 14 rotates a main gear 16 that engages two secondary gears 18, 20 which respectively drive a first stage airend 22 and a second stage airend 34. The first stage airend 22 has a fluid intake in communication with a filter 24. The fluid processed by the system is preferably a gas, such as air, and the filter 24 is preferably a gas filter in such a case. The filter 24 cleans the fluid before it is compressed in the first stage airend 22. Fluid compressed by the first stage airend 22 exits the airend and passes through a compressed fluid conduit 23 to an inter-cooler 26 that may include an air cooled or liquid cooled cooling device, such as a radiator or a heat exchanger. Cooled compressed fluid exiting the inter-cooler 26 is then passed through a conduit 27 as a cooled primary compressed fluid. The cooled primary compressed fluid passes through conduit 27 to a moisture separator 32 that removes condensate from the cooled primary compressed fluid. Along conduit 27, between the inter-cooler 26 and the moisture separator 32, a safety relief valve 28 is provided. The safety relief valve 28 is triggered open to release pressure when compressed fluid traveling through conduit 27 obtains a pressure that is an indication that the design pressure ratio permitted across the first stage has been exceeded. The valve 28 opens to prevent damage due to compressor overheating or overpressurization of the compressor casing, associated piping or other system components. For example, the safety relief valve 28 may open when the pressure in conduit 27 obtains a pressure that is from about 10% to about 25%, or from about 5 psig to about 10 psig, above a maximum value of the first stage pressure band for the primary compressed fluid, although any of a variety of triggering pressures could be used. For example, if the target first stage pressure band of the compressed fluid exiting first airend 22 through conduit 23 is from about 30 psig to about 40 psig, the safety relief valve 28 is preferably triggered to open when the pressure of the cooled primary compressed fluid in conduit 27 exceeds about 45 psig.

After the cooled primary compressed fluid exits moisture separator 32, it is passed through a conduit 29 to the second airend 34. Second airend 34 preferably receives the cooled primary compressed fluid at a pressure of, for example, from about 30 psig to about 40 psig, and compresses the cooled primary compressed fluid to a pressure of, for example, from about 100 psig to about 150 psig, to form what is referred to herein as a secondary compressed fluid. The secondary compressed fluid exiting second airend 34 flows through a conduit 35 to an after-cooler 36 that may include a radiator or heat exchange cooling device. The secondary compressed fluid exits after-cooler 36 as a cooled secondary compressed fluid through a conduit 37 to a second moisture separator 42. The second moisture separator 42 removes condensate from the cooled secondary compressed fluid. Along conduit 37, between after-cooler 36 and moisture separator 42, a second safety relief valve 38 is provided. The second safety relief valve 38 is triggered open when the pressure in conduit 37 exceeds the maximum second stage pressure band. The valve 38 opens to avoid any damage from high pressure to piping or other system components. Preferably, safety relief valve 38 opens when a pressure of from about 5% to about 15%, or from about 10 psig to about 20 psig, over the maximum second stage pressure band is obtained, although any of a variety of triggering pressures could be used. For example, if it is desired that cooled secondary compressed fluid exiting the second airend 34 has a pressure band, referred to herein as a second-stage pressure band, of from about 100 psig to about 150 psig, the second relief valve 38 is preferably triggered open when a pressure of about 165 psig, for example, is obtained.

Cooled secondary compressed fluid exiting moisture separator 42 flows through a conduit 43 to a check valve or ball valve 44 and from there to a compressed fluid system. Along conduit 43, between moisture separator 42 and check valve 44, a blowdown device is provided. In the embodiment shown in FIG. 1, the blowdown device includes a conduit 45 that communicates conduit 43 to a blowdown valve 48. Preferably, the blowdown valve 48 is a solenoid type valve. The blowdown solenoid valve 48 is controlled by signals, for example, electrical signals or pneumatic signals, sent from a control unit or controller 47. The signal transmission line to blowdown solenoid valve 48 from controller 47 is not shown in FIG. 1. Upon receiving a signal from controller 47 to open blowdown solenoid valve 48, the valve 48 is actuated to achieve an open position whereby secondary compressed fluid is enabled to flow through conduit 45, through blowdown solenoid valve 48, through a conduit 49 in communication with the blowdown solenoid valve 48, through a silencer 50 in communication with conduit 49, and to an outlet to the atmosphere. The silencer 50 can be a conventional muffler or a silencer well known to those of ordinary skill in the art.

According to an embodiment of the present invention, as exemplified in FIG. 1, a pressure sensor 46 may be provided, preferably downstream of check valve 44. The pressure sensor 46 is preferably in communication with the conduit 43 leading from check valve 44 to the compressed fluid system and senses the pressure of the cooled secondary compressed fluid passing through check valve 44 to the compressed fluid system. A signal indicative of the sensed pressure is sent from pressure sensor 46 along a signal line 51 to the system controller 47. In response to the signal received from the pressure sensor, the controller 47 generates a drive signal that is sent along signal line 53 to the rectifier/inverter drive 12. The signal sent from controller 47 along line 53 controls the rectifier/inverter drive 12 output so as to adjust the speed of motor 14 and thereby adjust the further pressurization of fluid in the system. The drive signal sent from controller 47 along line 53 to drive 12, in combination with the signal sent from controller 47 to the blowdown solenoid valve, can together control the pressure in the system to be maintained within a narrow pressure band while minimizing energy usage. In addition, because the variable speed system has no limit on the amount of times the motor can be started and stopped over a given period, the drive can be controlled so as to optimize energy savings by maximizing shut down time of the motor.

Figure 2:
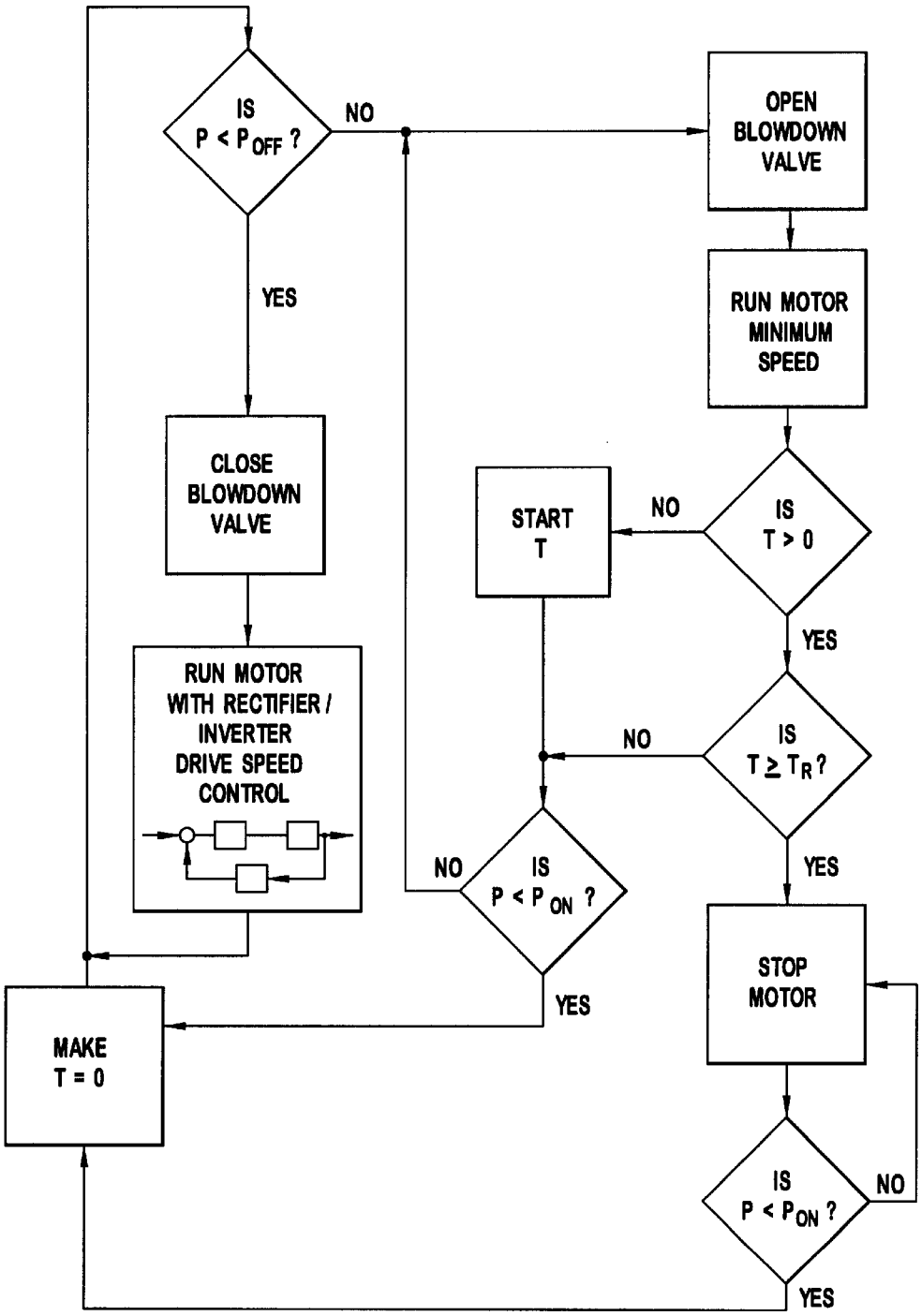
FIG. 2 is a schematic flow diagram of the logic control involved with carrying out a method according to an embodiment of the present invention.

A flow chart showing the logic control of a system in accordance with the present invention is shown in FIG. 2. In the logic flow diagram of FIG. 2, P represents the system pressure, that is, the pressure of the fluid exiting the compressor system. $P_{OFF}$ represents the maximum allowable system pressure, also referred to herein as the off-line pressure. $P_{ON}$ represents the minimum system pressure when the compressor system is not running in a constant pressure mode, also referred to herein as the on-line pressure. T represents a timer that logs or tracks the amount of time the motor is running off-line. $T_R$ represents a setting for the amount of time the motor will run off-line.

According to the compressor control logic, when the compressed air demand is below a minimum speed of the compressor, constant pressure will not be maintained with the motor drive speed control, but instead will run in a pressure band from $P_{ON}$ (minimum) to $P_{OFF}$ (maximum). To avoid starting and stopping of the motor when the pressure demand is just below the minimum speed of the compressor, the run-on timer (T) is employed, which runs the motor for a length of time ($T_R$). $T_R$ could be set to 0 if no run-on time is desired.

Depending upon the size of the various components used in the systems of the present invention, compressor systems having a wide variety of flow rates and pressurizations can be provided. For example, flow volumes in the range of from about 50 cubic feet per minute (cfm) or less to about 2000 cfm or more can be processed through the two-stage embodiment shown in FIG. 1. More preferably, a flow volume range of from about 200 cfm to about 1500 cfm can be processed to achieve a compressed fluid having a pressure of from about 100 to about 150 psig.

Although the embodiment shown in FIG. 1 features a two-stage compressor system, the present invention further encompasses oil-free single stage compressors and oil-free compressor systems having three or more stages of compression, in combination with a variable speed drive.

Although the embodiment of the present invention shown in FIG. 1 indicates that a single motor and variable speed drive are used to control both the first and second airends, it should be recognized by those skilled in the art that individual variable speed drives and motors can be used for each of the first and second airends respectively.

Although a preferred variable speed drive includes a rectifier/inverter drive, it should be recognized by those of skill in the art that other variable speed drive systems can be employed in accordance with the present invention, most preferably, variable speed drive systems having no limitation on the number of starts and stops the system can undergo over any given period of time. Another exemplary system employs a controllable DC power source that directly powers a variable speed electric motor.

Many individual components useful in the system of the present invention can individually be chosen from among components known and conventional to those skilled in the art. Exemplary gas compressor and liquid pump systems from which useful components may be utilized in accordance with the present invention include the systems described in U.S. Pat. No. 3,216,648 to Ford, U.S. Pat. No. 4,009,971 to Krohn et al., U.S. Pat. No. 4,828,462 to McBurnett, U.S. Pat. No. Re. 33,116 to Suzuki, U.S. Pat. No. 5,106,270 to Goettel et al., U.S. Pat. No. 5,284,202 to Dickey et al., U.S. Pat. No. 5,522,707 to Potter, U.S. Pat. No. 5,820,352, to Gunn et al., and U.S. Pat. No. 5,888,051 to McLoughlin et al., all of which are incorporated herein in their entireties by reference.

The oil-free dry screw compressor system of the present invention is particularly useful in the pressurization of air or gas. In accordance with the embodiments of the present invention described above, a compressor system can be provided that provides a compressed air pressure control across a 0% to 100% compressed air demand. The present invention can achieve a constant pressure across the 50% to 100% demand range of a dry screw compressor while at the same time providing an inexpensive means of achieving control in the 0% to 50% demand range. Because the system of the present invention reduces power consumption proportionately to the system demand and achieves zero compressor power when there is no demand, the system consumes much less energy than previously developed compressor systems that do not use variable speed drives capable of starting and stopping an unlimited number of times in a given time period.

In view of the variable speed design, the system of the present invention can preferably be free of an inlet valve for the compressors or airends, thus eliminating an essential complicated component in conventional systems.

It will be apparent to those skilled in the art that various modifications and variations can be made to the embodiments of the present invention without departing from the spirit or scope of the present invention. Thus, it is intended that the present invention covers other modifications and variations of this invention within the scope of the appended claims and their equivalents.

What is claimed is:

1. An oil-free dry screw compressor system comprising:

an oil-free dry screw compressor;

means for driving said compressor; and means for varying the speed of said means for driving, the means for varying configured to provide a drive signal to the means for driving such that the means for driving is operated at a speed within a range of speeds between a maximum speed and a minimum speed when a sensed compressor output pressure is less than a maximum compressor output pressure and the means for driving operates at a speed corresponding to the minimum speed for a given time T and thereafter is stopped when the sensed compressor output pressure is substantially equal to or greater than the maximum compressor output pressure.

2. The oil-free dry screw compressor system of claim 1, wherein said means for driving is a variable speed drive comprising an electric motor.

3. The oil-free dry screw compressor of claim 2, further comprising a three-phase AC current supply for powering said variable speed drive.

4. The oil-free dry screw compressor of claim 1, wherein said means for varying the speed comprises a rectifier/inverter drive.

5. The oil-free dry screw compressor of claim 1, further comprising means for carrying compressed fluid away from said compressor, means for sensing pressure in said means for carrying compressed fluid, and means for adjusting the means for varying the speed in response to a signal received from said means for sensing pressure.

6. The oil-free dry screw compressor of claim 5, further comprising a blowdown valve in communication with said means for carrying compressed fluid, and means for controlling opening and closing of the blowdown valve in response to a signal received from said means for sensing pressure.

7. The oil-free dry screw compressor of claim 1, wherein said compressor comprises a first airend and a second airend, wherein both the first airend and the second airend are powered by said means for driving.

8. The oil-free dry screw compressor system of claim 1 wherein the drive signal is substantially directly proportional to the compressor output pressure when the sensed compressor output pressure is less than the maximum compressor output pressure.

9. The oil-free dry screw compressor system of claim 1 wherein the given time T is equal to zero seconds.

10. The oil-free dry screw compressor system of claim 1 wherein the given time T is greater than zero seconds.

* * * * *